US010654496B2

(12) United States Patent
Shimokawa et al.

(10) Patent No.: US 10,654,496 B2
(45) Date of Patent: May 19, 2020

(54) RAILWAY VEHICLE DERAILMENT DETECTION METHOD AND DEVICE

(71) Applicant: NIPPON STEEL & SUMITOMO METAL CORPORATION, Tokyo (JP)

(72) Inventors: Yoshiyuki Shimokawa, Tokyo (JP); Daisuke Shinagawa, Tokyo (JP); Satoshi Kikko, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/076,355

(22) PCT Filed: Feb. 22, 2017

(86) PCT No.: PCT/JP2017/006542
§ 371 (c)(1),
(2) Date: Aug. 8, 2018

(87) PCT Pub. No.: WO2017/154573
PCT Pub. Date: Sep. 14, 2017

(65) Prior Publication Data

US 2019/0047597 A1 Feb. 14, 2019

(30) Foreign Application Priority Data

Mar. 11, 2016 (JP) ..... 2016-048067

(51) Int. Cl.
*B61F 9/00* (2006.01)
*B61K 13/00* (2006.01)
*B61L 11/02* (2006.01)

(52) U.S. Cl.
CPC ..... *B61F 9/005* (2013.01); *B61K 13/00* (2013.01); *B61L 11/02* (2013.01)

(58) Field of Classification Search
CPC ..... B61F 9/005; B61K 13/00; B61L 11/02
See application file for complete search history.

(56) References Cited

U.S. PATENT DOCUMENTS 3,998,413 A * 12/1976 Mygatt ..... B60T 7/124 246/172
4,286,763 A * 9/1981 Hayden ..... B60T 7/124 246/172

(Continued)

FOREIGN PATENT DOCUMENTS

CN 104428186 3/2015
JP 53-078717 6/1978

(Continued)

*Primary Examiner* — Babar Sarwar
(74) *Attorney, Agent, or Firm* — Clark & Brody LP

(57) ABSTRACT

A transmission line 5 configured to be broken when it comes into contact with a rail 4 is installed on a disengagement prevention guide 1 attached to an axle box 3 of a railway vehicle. One end 5*a* and the other end 5*b* of the transmission line 5 are connected to a determination unit 6 to monitor continuity of the transmission line 5. In the event of a derailment, the determination unit 6 determines that a derailment has occurred when the disengagement prevention guide 1 makes contact with the rail 4 and the transmission line 5 breaks, thereby interrupting the continuity of the transmission line 5. This arrangement allows an accurate detection of a derailment, so as to prevent a railway vehicle from traveling when its wheels have become disengaged from a rail without an operator being aware of it, thus improving safety after the derailment occurs.

4 Claims, 5 Drawing Sheets

(56) References Cited

U.S. PATENT DOCUMENTS 5,188,038 A * 2/1993 Shanley ..... B60T 7/124 104/242
5,492,290 A * 2/1996 Quinn ..... A63H 19/24 246/219
6,412,332 B1 * 7/2002 Bartonek ..... B61L 23/00 73/12.01
7,577,502 B1 * 8/2009 Henry ..... B61L 5/102 246/218
8,013,550 B1 * 9/2011 Young ..... A63H 19/24 246/187 A
2003/0236598 A1 * 12/2003 Villarreal Antelo ..... B61L 25/025 701/19
2004/0138814 A1 * 7/2004 Rajaram ..... B61L 23/34 701/301
2005/0251337 A1 * 11/2005 Rajaram ..... B61L 23/34 701/301
2011/0004446 A1 * 1/2011 Dorn ..... G01D 4/002 702/188
2013/0015298 A1 * 1/2013 Cooper ..... B61L 3/065 246/182 R
2014/0110537 A1 * 4/2014 Bartonek ..... G06F 11/30 246/169 R
2014/0118152 A1 * 5/2014 Bartonek ..... G01L 5/0052 340/665
2015/0339863 A1 * 11/2015 Allwardt ..... G07C 5/08 701/31.5
2019/0047597 A1 * 2/2019 Shimokawa ..... B61F 9/005

FOREIGN PATENT DOCUMENTS

JP 11-014838 1/1999
JP 2002-079941 3/2002
JP 2002-211396 7/2002
JP 2002-211400 7/2002
JP 3393032 4/2003
JP 2004-175156 6/2004
JP 2006-315518 11/2006
JP 2008-201372 9/2008
JP 2009-255823 11/2009
JP 5430216 2/2014
WO 2014/013650 1/2014
WO WO-2014013650 A1 * 1/2014 ..... B01F 9/005
WO WO-2017154573 A1 * 9/2017 ..... B61L 11/02

* cited by examiner

RAILWAY VEHICLE DERAILMENT DETECTION METHOD AND DEVICE

TECHNICAL FIELD

The present invention relates to a derailment detection method and device of a railway vehicle (referred to below simply as a "vehicle").

BACKGROUND ART

When a vehicle derails, the wheels disengage from the rails, and if an operator is unaware of the derailment, the vehicle continues traveling, resulting in greater damage due to the derailment. Therefore, early detection of derailment and stopping of the vehicle would result in improved safety after derailment occurs.

Various technologies relating to derailment detection were proposed in the past. One of them is a device that uses sensors to measure physical quantities such as acceleration and angular velocity that are applied to the vehicle body, and if signals extracted from the measured values exceed a threshold value, the device determines that a derailment has occurred (e.g., Patent Reference 1-3).

However, in cases where a derailment is detected on the basis of threshold values, differences in the accuracy of derailment detection can occur, depending on the threshold value settings. Thus, there is a problem in that the accuracy of derailment detection can be poor if the threshold values are not set at an optimal value.

In Patent Reference 4, as shown in FIG. 4 (*a*), there is disclosed a system for restricting the lateral movement of a bogie, provided with a ground-based equipment 11 (referred to below as a "derailment prevention guard") on an inner side of a pair of rails 4 and a stopper 14 that protrudes downward to the inner side portion of a wheel 13 of a bogie 12. As shown in FIG. 4 (*b*), in the event of a derailment, this system for restricting the lateral movement of a bogie restricts the movement of the bogie 12 in a lateral direction of the vehicle by having a contact portion 14*a* of the stopper 14 make contact with an inner side surface of the derailment prevention guard 11.

In Patent Reference 5, as shown in FIG. 5, there is disclosed a derailment and disengagement prevention system, provided with a stopper unit 16 at a lower portion of an axle box 17. In the event that a wheel 13 disengages from a rail 4, this derailment and disengagement prevention system moves a vehicle in a lateral direction of the vehicle, and a sloping member 16*a* formed on a stopper member 16 makes contact with the rail 4, so that the wheel 13 is positioned outside of the prescribed range of a fastening device 15 of the rail 4.

In Patent Reference 6 there is disclosed a fall prevention device provided with a stopper device 18 disposed at a lower portion of an axle box 17, as shown in FIG. 6. If a derailment occurs, this fall prevention device guides a vehicle so that it travels on a track bed to prevent the vehicle from falling, by causing a stopper piece 18*a* provided in a stopper device 18 to make contact with a side surface of a rail 4.

However, none of the systems disclosed in Patent References 4-6 detect a derailment. Therefore, it is incumbent on an operator to stop a vehicle after a derailment, but the probability is not zero that the vehicle will continue traveling while the wheels have disengaged from the rails, if the operator is unaware that a derailment has occurred.

On the other hand, in Patent Reference 7 there is disclosed a technology that provides a connecting device for producing electrical signals, and if the connecting device is disconnected, a command is delivered to an alarm device. This technology is provided instead of a vertical displacement detector provided parallel to an axle damper disposed between an axle box support unit and a bogie frame.

However, in the technology disclosed in Patent Reference 7, there are cases in which the connecting device does not become disconnected if a derailment occurs, depending on the durability of the connecting device and the performance of the axle damper. In such cases, a derailment cannot be detected.

In Patent Reference 8, there is disclosed a system for detecting a derailment, wherein a case is immobilized by a portion of a rotating bearing that rotatably supports an axle, and within this case is installed a vibration detector. Detection of a derailment results when a connecting support that connects a base of the vibration detector to a weight part is broken.

However, in the case of the system disclosed in Patent Reference 8, it is difficult to decide on a material, surface area, and shape of the connecting support such that only the connecting support reliably breaks if a derailment occurs. In other words, it is not necessarily the case that it is possible to reliably detect a derailment using the system disclosed in Patent Reference 8.

In Patent Reference 9, there is disclosed a technology for detecting derailment and falling of a railroad vehicle, wherein optical fiber is laid along the outer side of a pair of rails, and detection of derailment and falling of the railroad vehicle occurs when the optical fiber is cut.

However, in the technology disclosed in Patent Reference 9, there are cases in which the fall prevention device disclosed in Patent Reference 6 is installed, and there are cases in which the optical fiber does not break just because of a railway vehicle derailment, due to the position in which the optical fiber is laid. In addition, this technology cannot be considered to be practical, since the optical fiber must be laid along the entire length of track.

PRIOR ART REFERENCES

Patent References

Patent Reference 1: Japanese Patent Application Kokai Publication No. 2002-211396

Patent Reference 2: Japanese Patent Application Kokai Publication No. 2002-211400

Patent Reference 3: Japanese Patent Application Kokai Publication No. 2004-175156

Patent Reference 4: Japanese Patent No. 5430216

Patent Reference 5: Japanese Patent Application Kokai Publication No. 2006-315518

Patent Reference 6: Japanese Patent No. 3393032

Patent Reference 7: Japanese Patent Application Kokai Publication No. 2002-79941

Patent Reference 8: Japanese Patent Application Kokai Publication No. 2009-255823

Patent Reference 9: Japanese Patent Application Kokai Publication No. H11-14838

SUMMARY OF THE INVENTION

Problems to be Solved by the Invention

A problem that the present invention aims to solve is that derailment detection accuracy becomes poor if derailment detection depends on a determination of a derailment based on a threshold value, and if the set threshold value is not optimal. Another problem that the present invention aims to solve is that, even if the systems disclosed in Patent References 4-6 are installed, there is a possibility that a vehicle will continue to travel even if the wheels have disengaged from the rails, if the operator is unaware that a derailment has occurred. Yet another problem that the present invention aims to solve is that a derailment cannot necessarily be reliably detected using the technologies disclosed in Patent References 7-9.

Means for Solving these Problems

The object of the present invention is to detect derailments more accurately, without variations in derailment detection accuracy that depend on the threshold values that are set, and without a vehicle continuing to travel with the wheels disengaged from the rails, because an operator is unaware that a derailment has occurred.

In order to achieve this object, the railway vehicle derailment detection method according to the present invention employs a member disposed at a position on a vehicle that makes contact with a rail or a ground-based equipment installed on an inner side of a pair of rails, and that breaks due to contact with the rail or the ground-based equipment in the event of a derailment, determining that a derailment has occurred by detecting that the member has been broken due to contact with the rail or the ground-based equipment.

The method according to the present invention is implemented by employing a derailment detection device of the present invention comprising:

- a member that is installed in a portion of a railway vehicle, the member configured to be broken when a portion of the railway vehicle comes in contact with a rail or a ground-based equipment installed on an inner side of a pair of rails, and
- a device that determines that a derailment has occurred by detecting that the member has been broken when the portion of the railway vehicle comes in contact with the rail or the ground-based equipment.

In detail, an example of a portion of the vehicle that makes contact with the rail in the event of a derailment is a disengagement prevention guide attached to an axle box provided with a bearing that rotatably supports a wheel set or attached to a bogie. Examples of the member configured to be broken due to contact with the rail or the ground-based equipment installed on the inner side of a pair of rails include a transmission line installed at a contact surface of the disengagement prevention guide that makes contact with the rail or the ground-based equipment, a conductive coating applied on top of an insulating coating, a power supply line for transmitting brake signals to all of the constituent railway vehicles, a wiring of a detector for measuring vibration and/or temperature of the axle box. A vibration accelerometer or a temperature sensor may be used as a sensor for detecting that the member has been broken.

Advantageous Effects of the Invention

The present invention makes it possible to more accurately detect a derailment without making use of a threshold value, but rather, detects a derailment by utilizing a member configured to be broken by making contact with a rail, when a portion of a railway vehicle makes contact with a rail, for example, when a derailment occurs. Therefore, safety is improved after the derailment, because the vehicle does not continue traveling after the wheels have disengaged from the rail if an operator is unaware of the derailment.

BRIEF DESCRIPTION OF THE DRAWINGS

FIG. 1 (*a*) is a plan view; FIG. 1 (*b*) is a front view; and FIG. 1 (*c*) is a right side view.

FIG. 3 (*a*) illustrates a time of ordinary travel; FIG. 3 (*b*) illustrates a time when a derailment has occurred.

FIG. 4 (*a*) illustrates a time of ordinary travel; FIG. 4 (*b*) illustrates a time when a derailment has occurred.

EMBODIMENT OF THE INVENTION

The object of the present invention, which is to detect derailments more accurately, is achieved by detecting that a member has been broken due to contact with a rail or with the ground-based equipment, when a portion of the railway vehicle makes contact with the rail or with the ground-based equipment on an inner side of a pair of rails when a derailment has occurred.

Example

In the following, an example of the present invention is described, making reference to FIG. 1 and FIG. 2, after describing the process from conception of the invention to solving the problems of the prior art.

Recently, there are cases in which an L-shaped disengagement prevention guide 1 is installed in an axle box 3 of a high-speed train such as a bullet train, with the purpose of preventing a significant disengagement of a wheel from a rail during a derailment. The axle box 3 employs an internally mounted bearing to rotatably support a wheel set having a wheel 2.

The disengagement prevention guide 1 uses one plate 1*a* attached to a lower surface of the axle box 3 to cause another plate 1*b* to be lowered vertically so that a rail 4 comes to be located between the wheel 2 and the disengagement prevention guide 1, as viewed from the front side of the vehicle.

Figure 2:
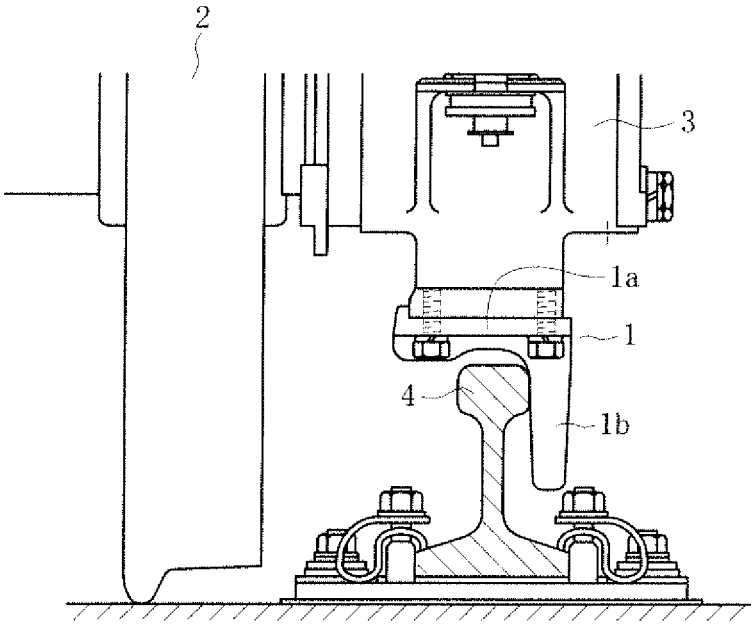
FIG. 2 is a drawing illustrating a state in which a disengagement prevention guide that forms the derailment detection device according to the present invention makes contact with a rail during a derailment.

In the case of a vehicle equipped with this disengagement prevention guide 1, if the vehicle derails and the wheel disengages from the rail 4, the vehicle undergoes no further displacement in the lateral direction of the vehicle, after the other plate 1*b* of the disengagement prevention guide 1 abuts the rail 4, as shown in FIG. 2.

That is to say, if the vehicle derails and the wheel disengages from the rail 4, the disengagement prevention guide 1 abuts the rail 4 when the vehicle becomes displaced in the lateral direction of the vehicle only by a predetermined distance.

Accordingly, the present inventors had the idea that it is possible to detect a derailment if a member is installed in the disengagement prevention guide 1 that can be broken when it makes contact with the rail 4, and if the breaking of the member can be detected.

The present invention is based on the above-described idea of the inventors. As shown in FIG. 1, for example, in the event of a derailment, at the position where the disengagement prevention guide 1 abuts the rail 4, there is provided a transmission line 5 on a side facing the rail 4 and extending from the one plate 1*a* to the other plate 1*b* of the disengagement prevention guide 1. In addition, one end 5*a* and the other end 5*b* of the transmission line 5 are connected to a determination unit 6, for example, to monitor continuity of the transmission line 5.

In the above-described configuration, when the disengagement prevention guide 1 abuts the rail 4 during a derailment, the transmission line 5 is cut, so the continuity of the transmission line 5 is interrupted. It is therefore possible to reliably detect derailments if the continuity of the transmission line 5 is monitored by using the two ends 5*a* and 5*b* of the transmission line.

After the determination unit 6 detects that the continuity of the transmission line 5 has been interrupted, thereby determining that a derailment has occurred, derailment data is transmitted to a control device on the derailed vehicle, using a wireless or wired transmission line. This causes the brakes to be activated to stop the vehicle, thereby preventing the vehicle from traveling on the rail while the wheels are disengaged from the rail.

Instead of employing an indirect method for detecting derailments involving a comparison of threshold values that are set in advance with signals extracted from physical quantities such as acceleration and angular velocity that are applied to the vehicle body, the present invention directly detects derailments by employing a physical phenomenon wherein the transmission line 5 is cut. This makes it possible to more accurately detect derailment of a railway vehicle.

The present invention is not limited to the above-described example, and the preferred embodiment may, of course, be advantageously modified within the scope of the technical ideas recited in the claims.

The above-described example employs the transmission line 5 as the member that is cut when the disengagement prevention guide 1 makes contact with the rail 4 during a derailment.

However, a power supply line for transmitting brake signals to all of the constituent railway vehicles may be used as the member that is cut in order to detect a derailment. In this case, it becomes possible to automatically apply brakes when the line is cut and derailment is detected.

In the case of a vehicle in which the vibration and/or temperature of the axle box 3 is measured, the wiring of this detector may be used as the member configured to be broken in the event of a derailment. In such cases, it is possible to constantly monitor whether or not there is an abnormality in the wiring, since vibration and temperature are measured during normal operation.

As long as it is possible to detect that breaking has occurred when the disengagement prevention guide 1 makes contact with the rail 4, a conductive coating that can peel when the disengagement prevention guide 1 makes contact with the rail 4 to interrupt conductive continuity may be applied on top of an insulating coating. A vibration accelerometer and/or a temperature sensor may be used as a sensor for detecting breaking of the member during a derailment.

Figure 1A:
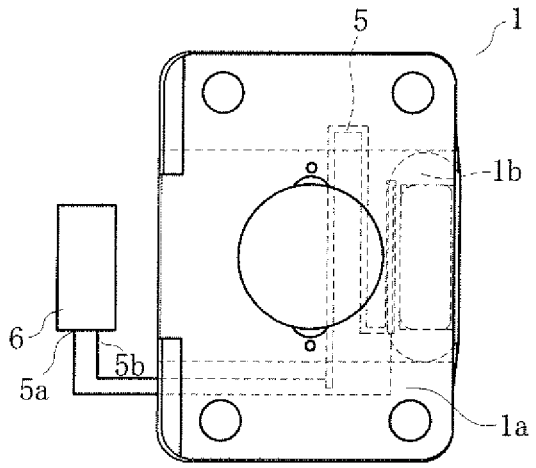
FIG. 1 is a drawing illustrating the main parts of the derailment detection device according to the present invention.
Figure 1B:
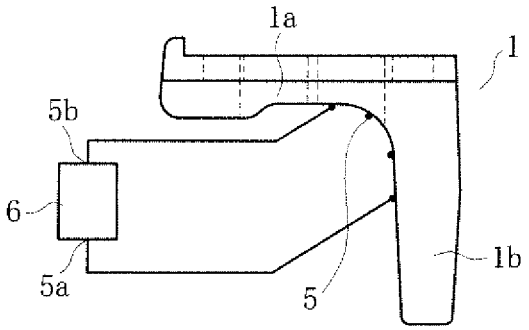
Figure 1C:
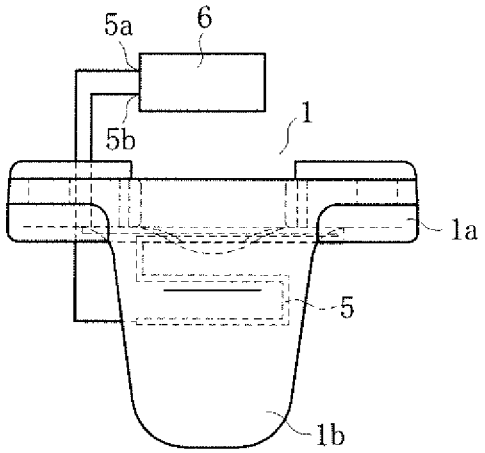
Figure 3A:
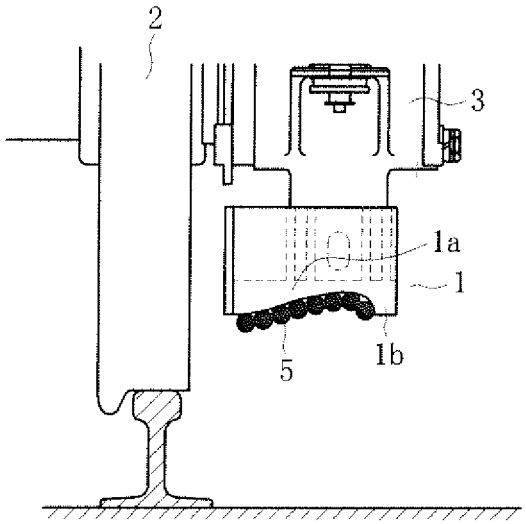
FIG. 3 is a drawing illustrating the derailment detection device according to the present invention that adds the technical ideas of the present invention to the disengagement prevention guide disclosed in Patent Reference 5.
Figure 3B:
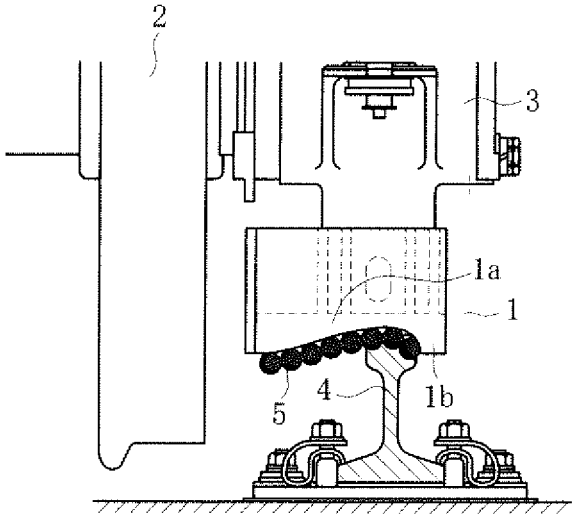
Figure 4A:
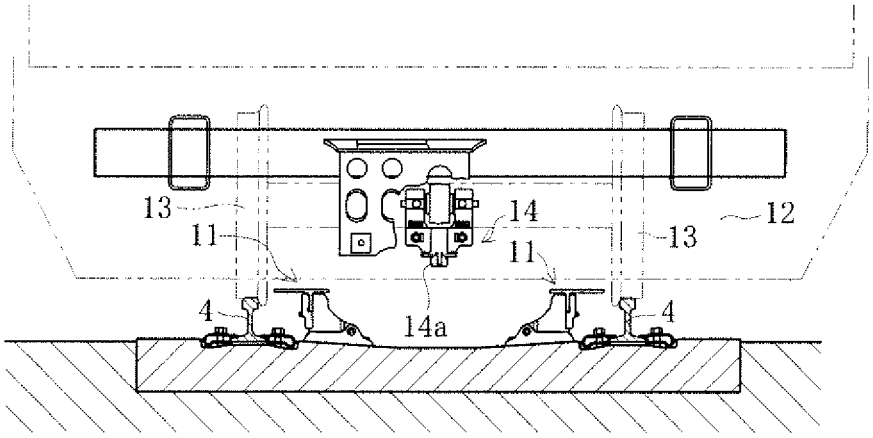
FIG. 4 is a drawing illustrating the system for restricting the lateral movement of a bogie disclosed in Patent Reference 4.
Figure 4B:
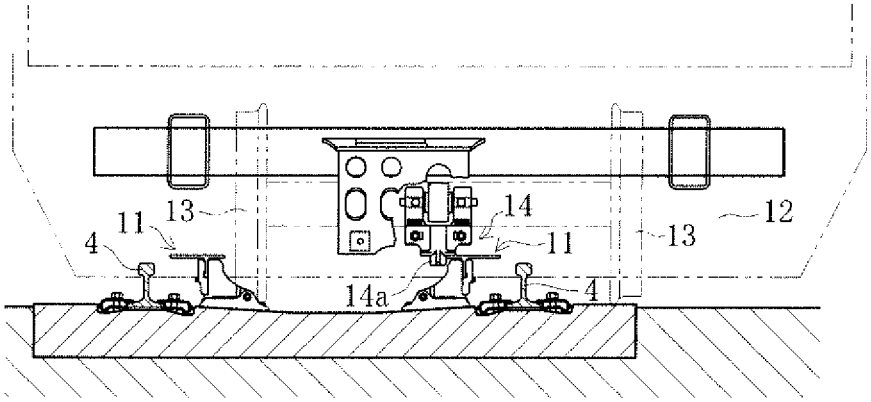
Figure 5:
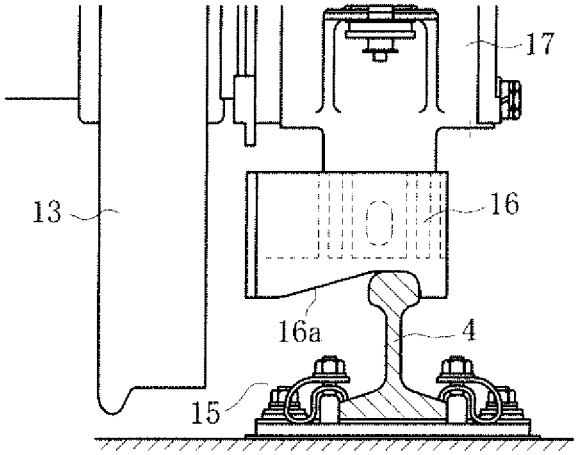
FIG. 5 is a drawing illustrating the derailment and disengagement prevention system disclosed in Patent Reference 5, at a time when a derailment has occurred.
Figure 6:
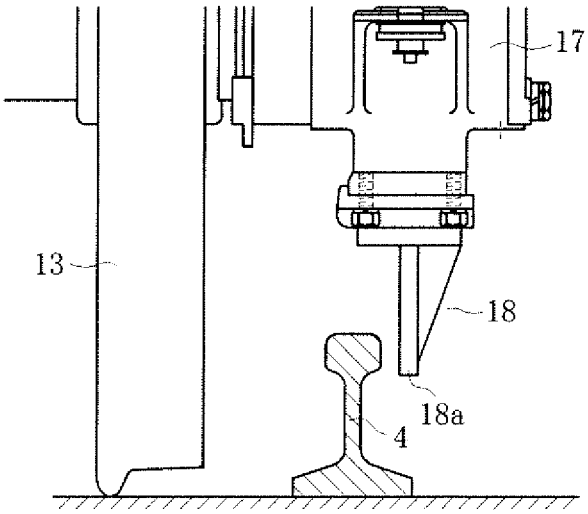
FIG. 6 is a drawing illustrating the railway vehicle fall prevention device disclosed in Patent Reference 6, at a time when a derailment has occurred.

The disengagement prevention guide 1 having a member configured to be broken during a derailment is not limited to the configuration shown in FIG. 1. It may have configuration that includes a stopper member of the type disclosed in Patent Reference 5, as shown in FIG. 3.

Instead of the disengagement prevention guide 1, it is possible to use a device that restricts the lateral movement of a bogie during a derailment by having a contact portion of a stopper make contact with an inner side surface of a ground-based equipment (derailment prevention guard) of the type disclosed in Patent Reference 4. In this case, the member that breaks during a derailment is disposed on the stopper side.

EXPLANATION OF THE REFERENCE SYMBOLS

1 Disengagement prevention guide
1*a* One plate
1*b* Another plate
2 Wheel
3 Axle box
4 Rail
5 Transmission line
6 Determination unit

The invention claimed is:

1. A railway vehicle derailment detection method for a railway vehicle traveling on a rail, comprising:

installing a derailment detection member disposed at a position on the railway vehicle that makes contact with a rail or a ground-based equipment installed on an inner side of a pair of rails, and that breaks due to direct contact with the rail or the ground-based equipment in event of a derailment; and determining that a derailment has occurred by detecting that the derailment detection member has been broken due to direct contact with the rail or the ground-based equipment;

wherein breaking of the derailment detection member prevents a railway vehicle from traveling when wheels of the railway vehicle become disengaged from the rail without knowledge of an operator of the railway vehicle.

2. A railway vehicle derailment detection device for a railway vehicle traveling on a rail, comprising:

a derailment detection member that is installed in a portion of the railway vehicle, the derailment detection member being configured to be broken when a portion of the railway vehicle comes in direct contact with a rail or a ground-based equipment installed on an inner side of a pair of rails; and a device that determines that a derailment has occurred by detecting that the derailment detection member has been broken when the portion of the railway vehicle comes in direct contact with the rail or the ground-based equipment;

wherein breaking of the derailment detection member prevents a railway vehicle from traveling when wheels of the railway vehicle become disengaged from the rail without knowledge of an operator of the railway vehicle.

3. The railway vehicle derailment detection device according to claim 2, wherein:

the portion of the railway vehicle that makes contact with the rail in the event of a derailment comprises a disengagement prevention guide attached to an axle box provided with a bearing that supports a rotatable wheel set; and the derailment detection member configured to be broken due to contact with the rail comprises one of (i) a transmission line installed on a surface of the disengagement prevention guide that makes contact with the rail, (ii) a conductive coating applied on top of an insulating coating, (iii) a power supply line for transmitting brake signals to all of the constituent railway vehicles, (iv) a wiring of a detector for measuring vibration and/or temperature of the axle box, (v) a vibration accelerometer, or (vi) a temperature sensor.

4. The railway vehicle derailment detection device according to claim 2, wherein:

the portion of the railway vehicle that makes contact with the ground-based equipment in the event of a derailment comprises a disengagement prevention guide attached to a bogie; and the derailment detection member configured to be broken due to contact with the ground-based equipment comprises one of (i) a transmission line installed on a surface of the disengagement prevention guide that makes contact with the ground-based equipment, (ii) a conductive coating applied on top of an insulating coating, (iii) a power supply line for transmitting brake signals to all of the constituent railway vehicles, (iv) a wiring of a detector for measuring vibration and/or temperature of the axle box, (v) a vibration accelerometer, or (vi) a temperature sensor.

* * * * *